US010819065B2

(12) United States Patent
Xiong et al.

(10) Patent No.: US 10,819,065 B2
(45) Date of Patent: Oct. 27, 2020

(54) ELECTRONIC BUILDING BLOCK AND BUILDING BLOCK KIT HAVING THE SAME

(71) Applicant: UBTECH ROBOTICS CORP LTD, Shenzhen (CN)

(72) Inventors: Youjun Xiong, Shenzhen (CN); Wenhua Fan, Shenzhen (CN); Jianxin Pang, Shenzhen (CN)

(73) Assignee: UBTECH ROBOTICS CORP LTD, Shenzhen (CN)

( * ) Notice: Subject to any disclaimer, the term of this patent is extended or adjusted under 35 U.S.C. 154(b) by 0 days.

(21) Appl. No.: 16/445,243

(22) Filed: Jun. 19, 2019

(65) Prior Publication Data

US 2020/0161803 A1 May 21, 2020

(30) Foreign Application Priority Data

Nov. 20, 2018 (CN) ..... 2018 1 1381711

(51) Int. Cl.
*H01R 13/62* (2006.01)
*H01R 13/22* (2006.01)

(52) U.S. Cl.
CPC ..... *H01R 13/6205* (2013.01); *H01R 13/22* (2013.01)

(58) Field of Classification Search
CPC ..... H01R 13/6205; H01R 11/30
USPC ..... 439/38, 39, 40; 335/91, 92, 103
See application file for complete search history.

(56) References Cited

U.S. PATENT DOCUMENTS 5,829,987 A * 11/1998 Fritsch ..... H01R 13/7037 439/38
5,921,783 A * 7/1999 Fritsch ..... H01R 13/703 439/38
6,062,937 A * 5/2000 Kikuchi ..... A63H 33/042 446/484
7,402,045 B2 * 7/2008 Schwartzbart ..... H01R 11/30 439/38
8,491,312 B2 * 7/2013 Rudisill ..... H01R 11/30 439/39
8,596,881 B2 * 12/2013 Umeno ..... G02B 6/3817 385/53
9,019,718 B2 * 4/2015 Bdeir ..... H01R 13/6205
9,583,244 B2 * 2/2017 Yoshida ..... H01F 41/0273
9,597,607 B2 * 3/2017 Bdeir ..... H01R 13/6205
9,755,357 B1 * 9/2017 Kim ..... H01R 13/6205
(Continued)

FOREIGN PATENT DOCUMENTS

CN 104941216 A 9/2015
CN 107854849 A 3/2018

*Primary Examiner* — Peter G Leigh

(57) ABSTRACT

An electronic building block includes a first side and a second side, a first magnet fixed to the first side and including a number of first magnet segments, a second magnet fixed to the second side and including a number of second magnet segments, a first power contact, a second power contact and a first communication contact arranged on the first side; and a third power contact, a fourth power contact and a second communication contact arranged on the second side and respectively coming into contact with the first power contact, the second power contact, and the first communication contact when the first magnet segments of one of two electronic building blocks is connected to the second magnet segments of the other of two electronic building blocks.

13 Claims, 9 Drawing Sheets

(56) References Cited

U.S. PATENT DOCUMENTS

| | | | | |
|---|---|---|---|---|
| 2006/0111010 | A1* | 5/2006 | Park | A63H 33/046 446/92 |
| 2010/0279517 | A1* | 11/2010 | Tsai | H01R 24/38 439/38 |
| 2011/0090033 | A1* | 4/2011 | Sankar | H01F 7/021 335/306 |
| 2012/0262019 | A1* | 10/2012 | Smith | H02K 21/145 310/156.07 |
| 2012/0295451 | A1* | 11/2012 | Hyun-Jun | H01R 13/6205 439/39 |
| 2013/0102164 | A1* | 4/2013 | Sip | H01R 13/642 439/38 |
| 2016/0093426 | A1* | 3/2016 | Yoshida | H01F 41/0266 335/306 |
| 2016/0190736 | A1* | 6/2016 | Chun | H01R 13/6205 439/39 |

* cited by examiner

ELECTRONIC BUILDING BLOCK AND BUILDING BLOCK KIT HAVING THE SAME

CROSS REFERENCE TO RELATED APPLICATIONS

This application claims priority to Chinese Patent Application No. 201811381711.2, filed Nov. 20, 2018, which is hereby incorporated by reference herein as if set forth in its entirety.

BACKGROUND

1. Technical Field

The present disclosure generally relates to toy building blocks, and particularly to a building block kit including building blocks that are connected to one another by magnetic force.

2. Description of Related Art

A wide variety of block toys presently exist, including those permitting connection of individual blocks by mutually snapping concave portions and convex portions formed in and on the individual blocks and those making use of a magnet arranged on a block and a magnetic member arranged on another block so that these blocks can be connected together by magnetic force. Although these block engagement means can work well for connecting the blocks together, it is still desirable and useful to provide a building block kit including building blocks that are connected to one another by a new connection mechanism.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, all the views are schematic, and like reference numerals designate corresponding parts throughout the several views.

DETAILED DESCRIPTION

Figure 1:
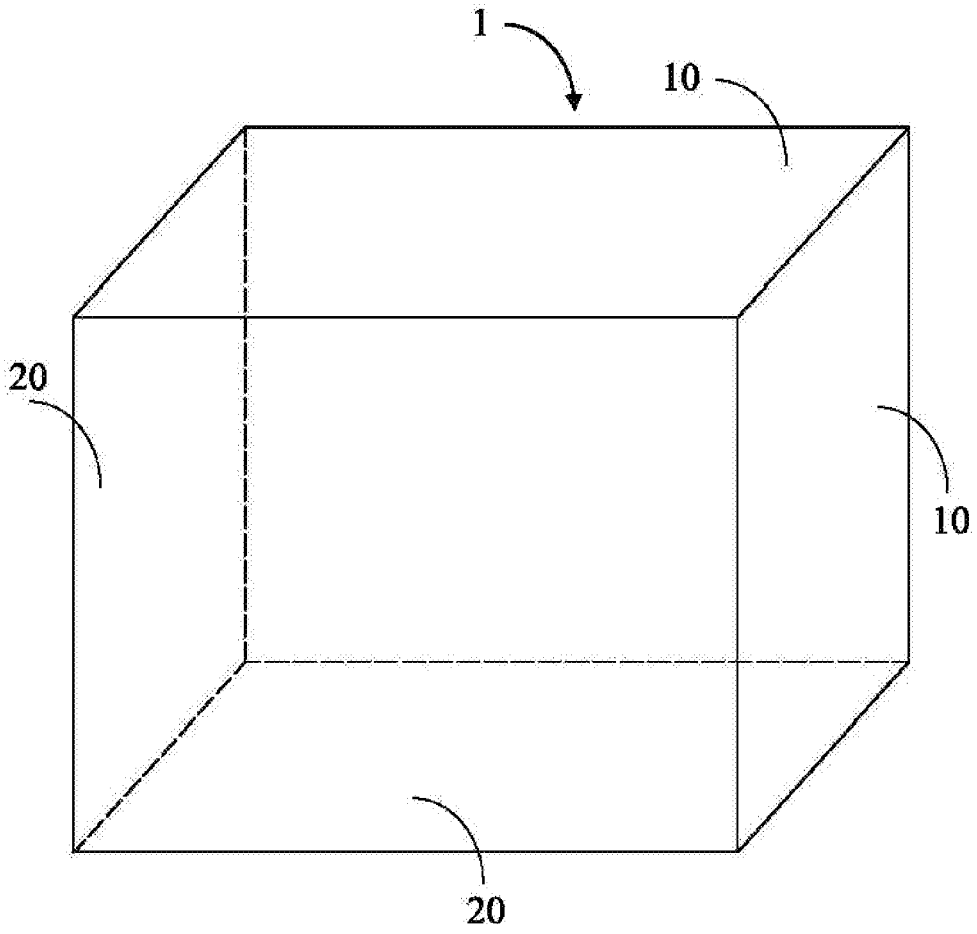
FIG. 1 is a schematic isometric view of an electronic building block according to an embodiment.

The disclosure is illustrated by way of example and not by way of limitation in the figures of the accompanying drawings, in which like reference numerals indicate similar elements. It should be noted that references to "an" or "one" embodiment in this disclosure are not necessarily to the same embodiment, and such references can mean "at least one" embodiment.

The terms "upper", "lower", "left" and "right", indicating the orientational or positional relationship based on the orientational or positional relationship shown in the drawings, are merely for convenience of description, but are not intended to indicate or imply that the device or elements must have a particular orientation or be constructed and operated in a particular orientation, and therefore should not be construed as limiting the present invention. The terms "first" and "second" are used for descriptive purposes only and are not to be construed as indicating or implying relative importance or implicitly indicating the number of technical features. The meaning of "multiple" is two or more, unless expressly stated otherwise.

In one embodiment, an electronic polyhedral building block having a number of faces, each of which includes M sides, includes: at least one first face and at least one second face, a first magnet fixed to the at least one first face, and a second magnet fixed to the at least one second face. The first magnet includes 2*M first magnet segments having north poles (N-poles) and south poles (S-poles) on upper surfaces thereof, and ones of the first magnet segments having the N-poles and the other ones of the first magnet segments having the S-poles are alternately arranged. The second magnet includes 2*M second magnet segments having N-poles and S-poles on upper surfaces thereof, and ones of the second magnet segments having the N-poles and the other ones of the second magnet segments having the S-poles are alternately arranged. The first magnet segments and the second magnet segments are arranged in such a way that the first magnet segments of one of two electronic building blocks are able to be magnetically connected to the second magnet segments of the other of two electronic building blocks when the at least one first face and the at least one second face of the two electronic building blocks abut against each other. The electronic polyhedral building block further includes a first power contact, a second power contact and a first communication contact arranged on the at least one first face, and a third power contact, a fourth power contact and a second communication contact arranged on the at least one second face and respectively coming into contact with the first power contact, the second power contact, and the first communication contact when the first magnet segments of one of two electronic building blocks is connected to the second magnet segments of the other of two electronic building blocks. M is a natural number that is greater than 1. In the embodiment as shown in FIGS. 1-4, M equals to 4. In an alternative embodiment as shown in FIG. 5, M may equal to 6.

Figure 2:
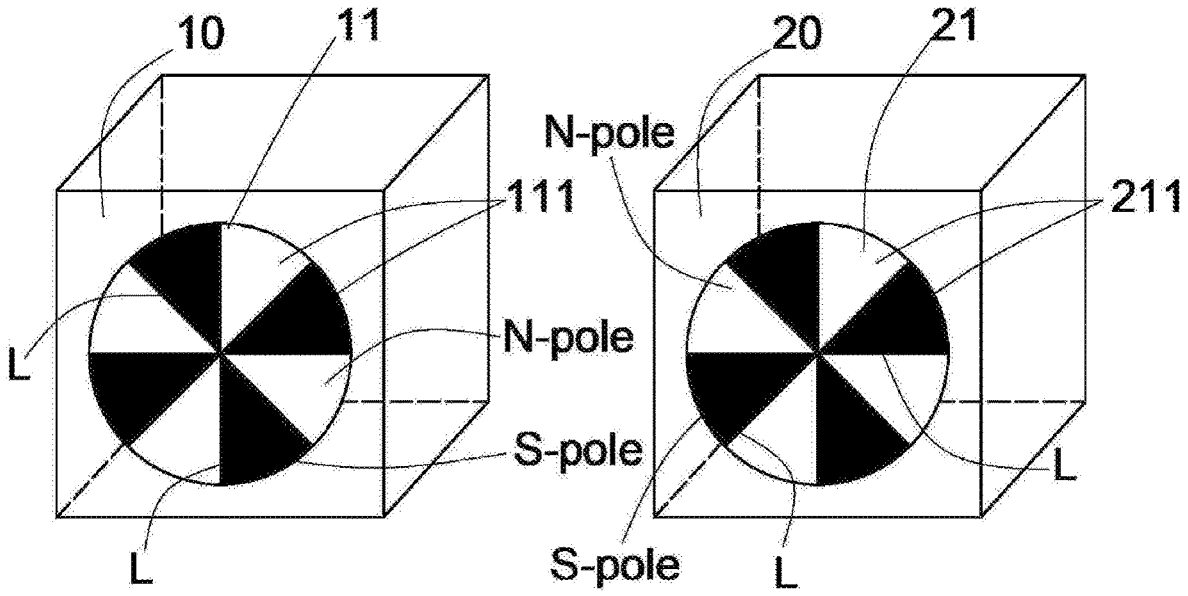
FIG. 2 is a schematic isometric view of the electronic building block of FIG. 1, showing magnets on a first side and a second side of the electronic building block.
Figure 3:
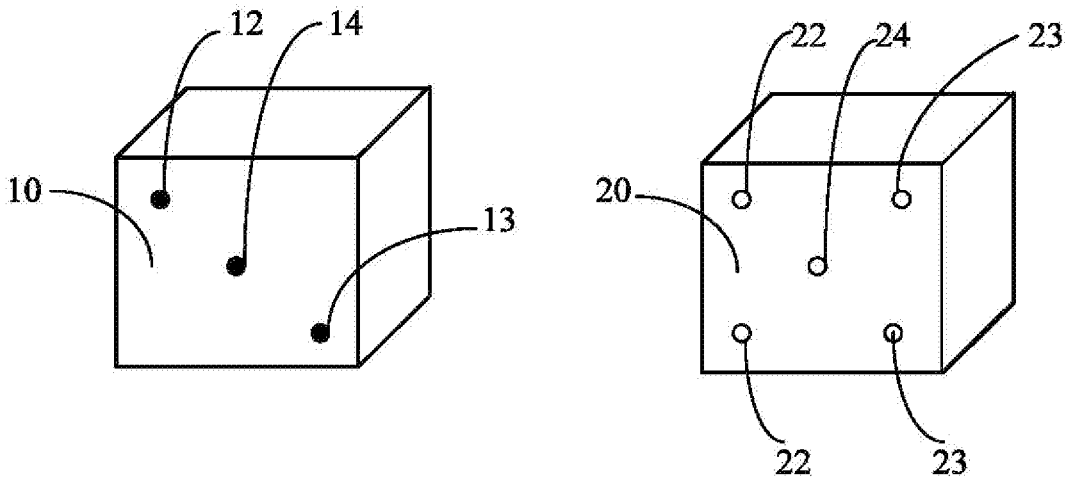
FIG. 3 is a schematic isometric view of the electronic building block of FIG. 1, showing power contacts and communication contacts on the first side and the second side of the electronic building block.

Referring to FIGS. 1-3, in one embodiment, a cubic electronic building block 1 has six sides including three first sides 10 and three second sides 20 that respectively oppose and parallel the three first sides 10. The first sides 10 are perpendicular to one another and have a common apex. The second sides 20 are perpendicular to one another and have a common apex. Three first magnets 11 are respectively fixed to the first sides 10, and three second magnets 21 are respectively fixed to the second sides 20. In the embodiment, each of the first magnets 11 includes eight magnet segments 111, and each of the second magnets 21 includes eight magnet segments 211. The magnet segments 111 and 211 have north poles (N-poles) and south poles (S-poles) on upper surfaces thereof. Ones of the magnet segments 111 having the N-poles and the other ones of the magnet segments 111 having the S-poles are alternately arranged on each of the first sides 10. Ones of the magnet segments 211 having the N-poles and the other ones of the magnet segments 211 having the S-poles are alternately arranged on each of the second sides 20. Specifically, on each of the first sides 10 and the second sides 20, magnetic poles on the upper surfaces of the magnet segments 111 and 211 are alternately arranged in a manner like N, S, N, S. . . . As shown in FIG. 2, when viewed by a same viewer, the magnet segments 111 on any of the first sides 10 and the magnet segments 211 on any of the second sides 20 are arranged in the same manner. In the embodiment, each of the magnet segments 111 and 211 is in the shape of a circular sector, and the magnet segments 111 on any of the first sides 10 corporately form a disc, and the magnet segments 211 on any of the second sides 20 corporately form a disc. With such configuration, any of the first sides 10 of a first electronic building block 1 can be easily connected to any of the second sides 20 of a second electronic building block 1 when the first side 10 of the first electronic building block 1 and the second side 20 of the second electronic building block 1 abut against each other, by force of magnetic attraction between the magnet segments 111 and 211 on the first side 10 and the second side 20.

In one embodiment, the electronic building block 1 further includes a first power contact 12, a second power contact 13 and a first communication contact 14 arranged on each of the first sides 10, and a third power contact 22, a fourth power contact 23 and a second communication contact 24 arranged on each of the second side 20. The third power contact 22, the fourth power contact 23 and the second communication contact 24 respectively make contact with the first power contact 12, the second power contact 13, and the first communication contact 14 when the magnet segments 111 of the first electronic building block 1 is connected to the magnet segments of 211 of the second electronic building block 1.

With such configuration, two electronic building blocks 1 can be easily connected to each other by force of magnetic attraction between the magnet segments 111 on the first side 10 and the magnet segments 211 on the second side 20 thereof. In addition, after the two electronic building blocks 1 are attached to each other, the third power contact 22, the fourth power contact 23 and the second communication contact 24 respectively make contact with the first power contact 12, the second power contact 13, and the first communication contact 14, thereby electrically coupling the two electronic building blocks 1 together and allowing a control signal to be transmitted between the two electronic building blocks 1.

In the embodiment, the number of the magnet segments 111 on each of the first sides 10 and the magnet segments 211 on each of the second sides 20 is eight. Each of the magnet segments 111 and 211 thus has a central angle of 45 degrees. The boundary line L between two adjacent magnet segments 111 is parallel to the sides or diagonal lines of the first sides 10. The boundary line L between two adjacent magnet segments 211 is parallel to the sides or diagonal lines of the second sides 10. Thus, each of the first sides 10 and the second sides 20 is equally divided into four parts by two straight lines parallel to the sides, or divided into four equal parts by diagonal lines. In each of the divided areas, two magnet segments 111 or 211 having opposite magnetic poles on their upper surfaces are provided, thereby enhancing the magnetic attracting force between the first side 10 and the second 20 that abut against each other.

Referring to FIG. 3, in one embodiment, the first contact 12, the first communication contact 14 and the second contact 13 are arranged at a first distance from each other along a diagonal line of the first side 10, with the first communication contact 14 being located at the center of the first side 10. In the embodiment, the second side 20 is provided with two third power contacts 22, two fourth power contacts 23 and one second communication contact 24. One third power contact 22, the second communication contact 24 and one fourth power contact 23 are arranged at a second distance from each other along a diagonal line of the second side 20. The other third power contact 22, the second communication contact 24 and the other fourth power contact 23 are arranged at a third distance from each other along the other diagonal line of the second side 20, with the second communication contact 24 being located at the center of the second side 20. The first distance, the second distance, and the third distance are equal to one another. With such configuration, two electronic building blocks 1 can be electrically coupled to each other easily when the first side 10 of one electronic building block 1 and the second side 20 of the other electronic building block 1 are coincident with each other.

Figure 6:
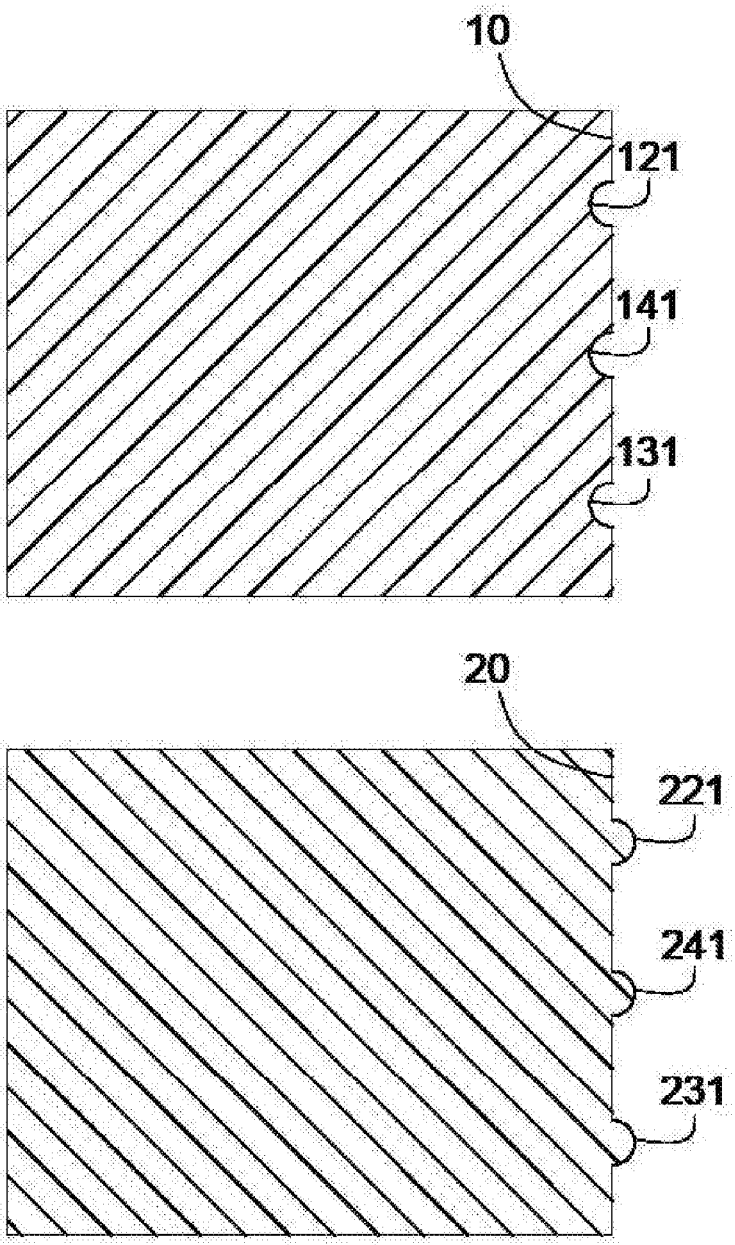
FIG. 6 shows two schematic cross-sectional views of the electronic building block according to a first embodiment.
Figure 7:
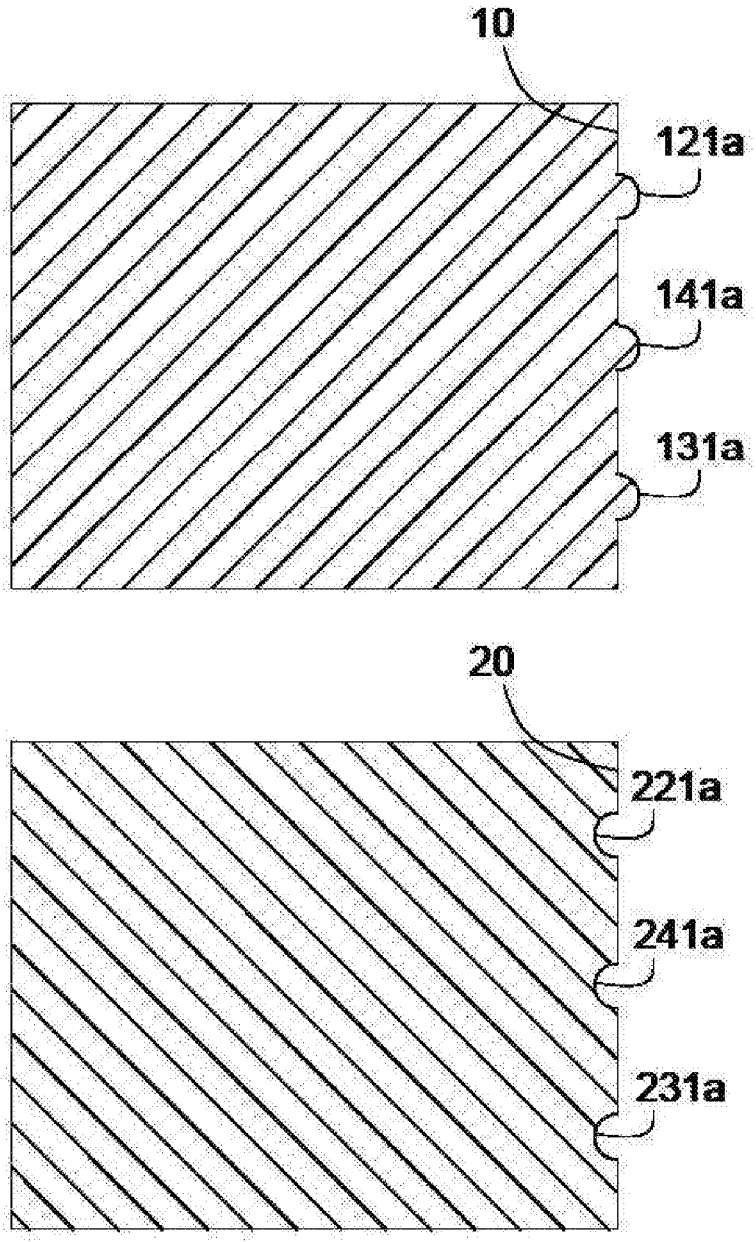
FIG. 7 shows two schematic cross-sectional views of the electronic building block according to a second embodiment.
Figure 8:
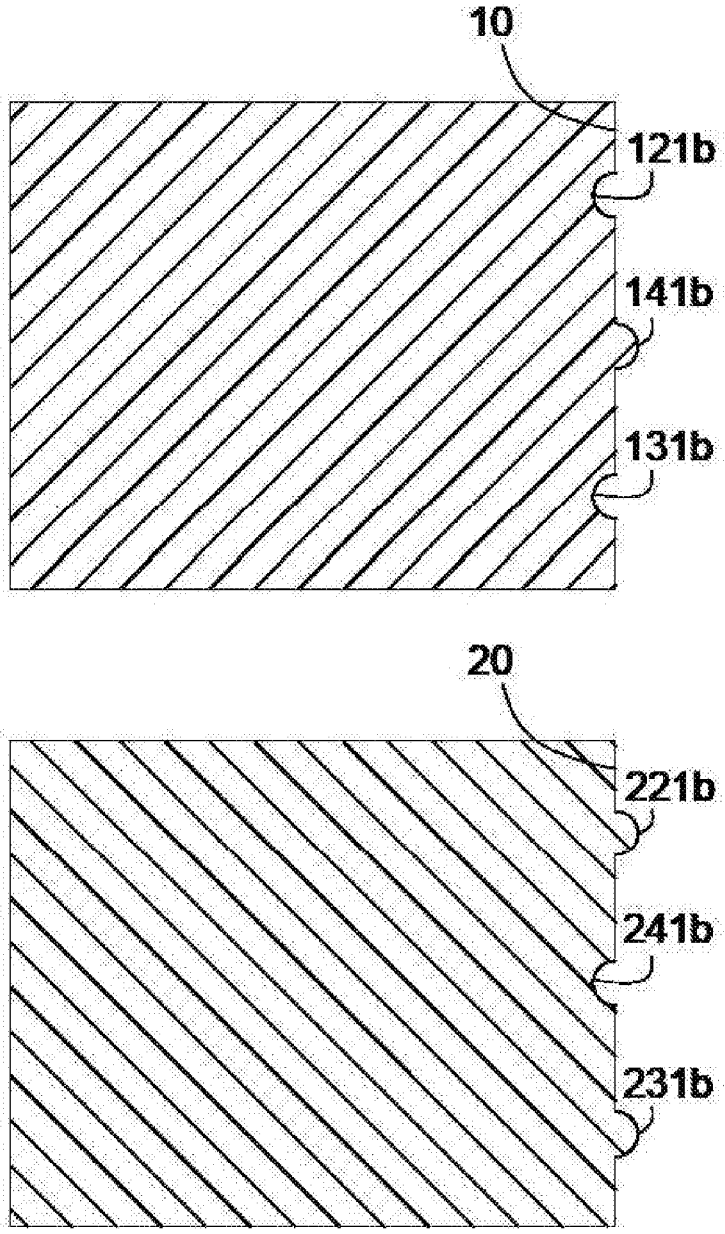
FIG. 8 shows two schematic cross-sectional views of the electronic building block according to a third embodiment.
Figure 9:
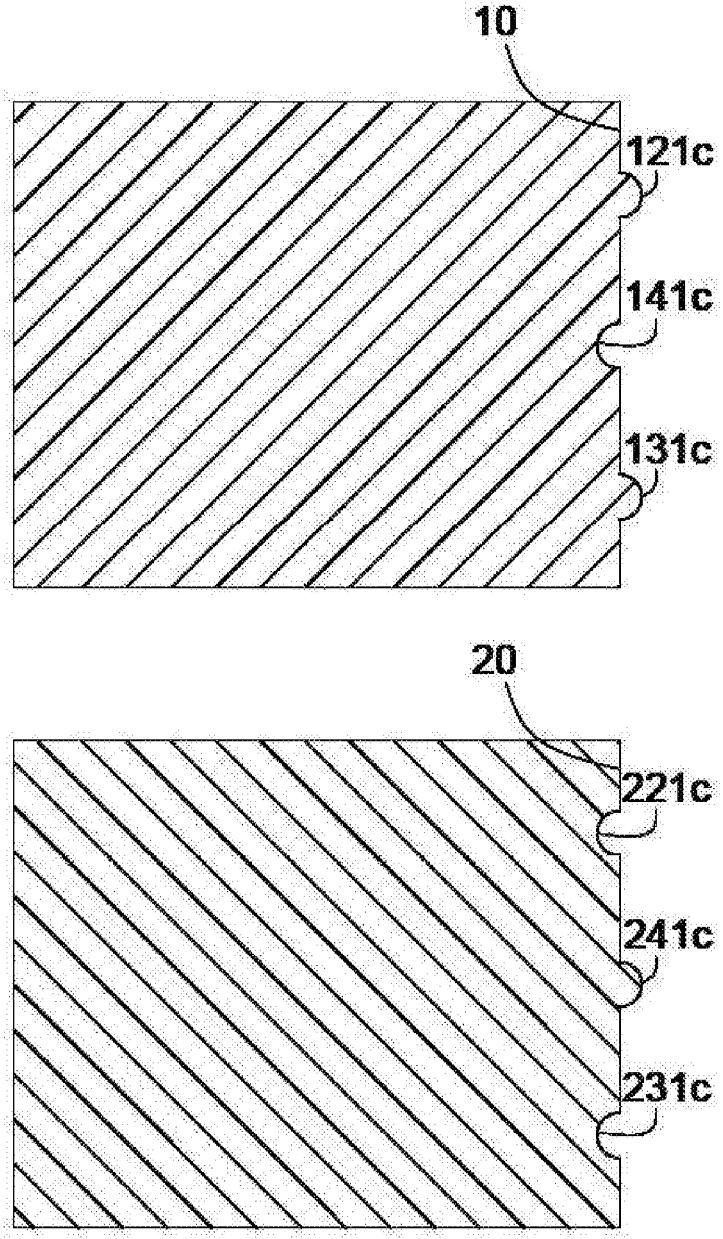
FIG. 9 shows two schematic cross-sectional views of the electronic building block according to a fourth embodiment.

In one embodiment, as shown in FIG. 6, the first power contact 12, the second power contact 13, and the first communication contact 14 have concave surfaces 121, 131 and 141, respectively, and the third power contact 22, the fourth power contact 23 and the second communication contact 24 have convex surfaces 221, 231 and 241, respectively. In the embodiment, the above-mentioned contacts are all made of metal sheet. When the first side 10 of one electronic building block 1 and the second side 20 of the other electronic building block 1 are coincident with each other, the convex surfaces 221, 231 and 241 of the contacts 22, 23 and 24 of the second side 20 are respectively fit in the concave surfaces 121, 131 and 141 of the contacts 12, 13 and 14 of the first side 10. In an alternative embodiment, as shown in FIG. 7, the first power contact 12, the second power contact 13, and the first communication contact 14 may have a convex surface 121*a*, 131*a* and 141*a*, respectively, and the third power contact 22, the fourth power contact 23 and the second communication contact 24 may have a concave surface 221*a*, 231*a* and 241*a*, respectively. In an alternative embodiment, as shown in FIG. 8, the first power contact 12, the second power contact 13, and the second communication contact 24 may have concave surfaces 121*b*, 131*b* and 241*b*, respectively, and the third power contact 22, the fourth power contact 23 and the first communication contact 14 may have convex surfaces 221*b*, 231*b* and 141*b*, respectively. In an alternative embodiment, as shown in FIG. 9, the first power contact 12, the second power contact 13, and the second communication contact 24 may have convex surfaces 121*c*, 131*c* and 241*c*, respectively, and the third power contact 22, the fourth power contact 23 and the first communication contact 14 may have concave surfaces 221*c*, 231*c* and 141*c*, respectively.

With such configuration, when the first side 10 of one electronic building block 1 and the second side 20 of the other electronic building block 1 are coincident with each other, the first power contact 12 comes into contact with one of the third power contact 22 and the fourth power contact 23, the second power contact 13 comes into contact with the other one of the third power contact 22 and the fourth power contact 23, and the first communication contact 14 comes into contact with the second communication contact 24. In other words, two electronic building blocks 1 can be electrically coupled to each other easily as long as the first side 10 of one electronic building block 1 and the second side 20 of the other electronic building block 1 are coincident with each other.

Figure 4:
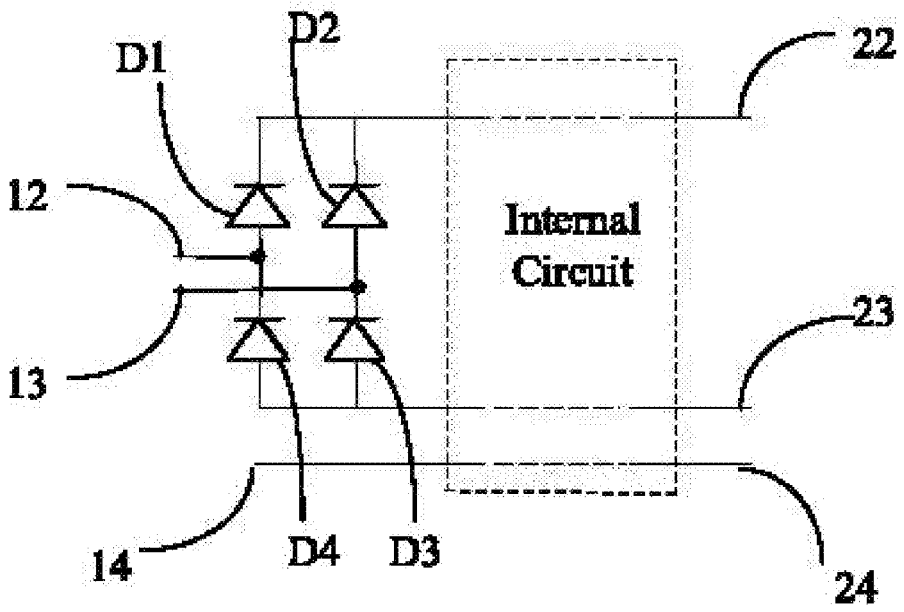
FIG. 4 is a schematic diagram of a rectifier circuit of the electronic building block of FIG. 1.
Figure 5:
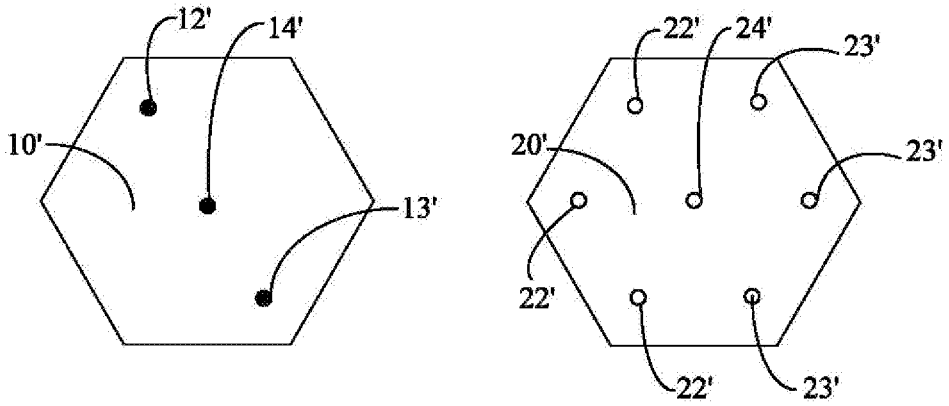
FIG. 5 is a schematic isometric view of the electronic building block according to an alternative embodiment, showing power contacts and communication contacts on a first face and a second face of the electronic building block.

Referring to FIG. 4, in one embodiment, in order to ensure that the internal circuit of the electronic building block 1 can achieve the correct power connection, the electronic building block 1 further includes therein a rectifier circuit 15 adjacent to the first side 10. The rectifier circuit 15 includes a first diode D1, a second diode D2, a third diode D3, and a fourth diode D4 that each have a positive pin and a negative pin. The positive pin of the first diode D1 and the negative pin of the fourth diode D4 are commonly connected to the first power contact 12. The positive pin of the second diode D2 and the negative electrode of the third diode D3 are commonly connected to the second power contact 13. The negative pin of the first diode D1 and the negative pin of the second diode D2 are commonly connected to the third power contact 22. The positive pin of the third diode D3 and the positive pin of the fourth diode D4 are commonly connected to the fourth power contact 23. With the above-mentioned rectifier circuit 15, it can be ensured that a correct power connection can be achieved when either the first power contact 12 and the second power contact 13 come into contact with the third power contact 22.

FIG. 5 shows an embodiment of an electronic building block which differs from the electronic building block 1 in that each face of the electronic building block is a hexagon. The electronic building block is constructed as described above. A first face 10' includes a first power contact 12', a second power contact 13' and a first communication contact 14'. The first contact 12', the first communication contact 14' and the second contact 13' are arranged at a first distance from each other along a diagonal line of the first face 10', with the first communication contact 14' being located at the center of the first face 10'. A second face 20' that is parallel to the first face 10' includes three third power contacts 22', three fourth power contacts 23' and a second communication contact 24'. The second communication contact 24' is located at the center of the second face 20'. The third power contacts 22' and the fourth power contacts 23' are arranged in such a way that any of the three diagonal lines of the second face 20' passing through the center of the second face 20' passes through one power contact 22' and one power contact 23'. With such configuration, two electronic building blocks of the embodiment can be electrically coupled to each other easily when the first face 10' of one electronic building block and the second face 20 of the other electronic building block are coincident with each other.

In the embodiment as shown in FIG. 5, each of the first magnets of the first face 10' and the second magnets of the second face 20' includes twelve magnet segments. The magnet segments have N-poles and S-poles on upper surfaces thereof. Ones of the magnet segments having the N-poles and the other ones of the magnet segments having the S-poles are alternately arranged on each of the first face 10' and the second face 20'. Specifically, on each of the first face 10' and the second face 20', magnetic poles on the upper surfaces of the magnet segments are alternately arranged in a manner like N, S, N, S, . . . When viewed by a same viewer, the magnet segments on the first face 10 and the magnet segments on the second face 20 are arranged in the same manner. In the embodiment, each of the magnet segments is in the shape of a circular sector, and the magnet segments on any of the first face 10' and the second face 20' corporately form a disc. With such configuration, the first face 10' of a first electronic building block can be easily connected to the second face 20' of a second electronic building block when the first face 10' of the first electronic building block and the second face 20' of the second electronic building block abut against each other, by force of magnetic attraction between the magnet segments on the first face 10' and the second face 20'.

In one embodiment, a building block kit includes a number of aforementioned electronic building blocks that can be mechanically connected to and electrically coupled to one another. The building block kit may include other components, such as power source module, remote controller, etc.

Although the features and elements of the present disclosure are described as embodiments in particular combinations, each feature or element can be used alone or in other various combinations within the principles of the present disclosure to the full extent indicated by the broad general meaning of the terms in which the appended claims are expressed.

What is claimed is:

1. An electronic building block comprising:

a plurality of sides comprising at least one first side and at least one second side, a first magnet fixed to the at least one first side, the first magnet comprising a plurality of first magnet segments having N-poles and S-poles on upper surfaces thereof, ones of the first magnet segments having the N-poles and the other ones of the first magnet segments having the S-poles being alternately arranged;

a second magnet fixed to the at least one second side, the second magnet comprising a plurality of second magnet segments having N-poles and S-poles on upper surfaces thereof, ones of the second magnet segments having the N-poles and the other ones of the second magnet segments having the S-poles being alternately arranged, wherein the first magnet segments and the second magnet segments are arranged in such a way that the first magnet segments of one of two electronic building blocks are able to be magnetically connected to the second magnet segments of the other of two electronic building blocks when the at least one first side and the at least one second side of the two electronic building blocks abut against each other;

a first power contact, a second power contact and a first communication contact arranged on the at least one first side; and a third power contact, a fourth power contact and a second communication contact arranged on the at least one second side and respectively coming into contact with the first power contact, the second power contact, and the first communication contact when the first magnet segments of one of two electronic building blocks is connected to the second magnet segments of the other of two electronic building blocks;

wherein each of the first magnet segments and the second magnet segments is in a shape of a circular sector, the first magnet segments corporately form a first disc, and the second magnet segments corporately form a second disc, the first disc and the second disc allow the first magnet segments of one of two electronic building blocks to be connected to the second magnet segments of the other of two electronic building blocks when the at least one first side and the at least one second side of the two electronic building blocks abut against each other.

2. The electronic building block according to claim 1, wherein the at least one first side and the at least one second side are rectangular, the first power contact, the second power contact and the first communication contact are arranged along a diagonal of the at least one first side, and the third power contact, the fourth power contact and the second communication contact are arranged along a diagonal of the at least one second side.

3. The electronic building block according to claim 1, further comprising a rectifier circuit, wherein the rectifier circuit comprises a first diode, a second diode, a third diode, and a fourth diode that each have a positive pin and a negative pin, the positive pin of the first diode and the negative pin of the fourth diode are commonly connected to the first power contact, and the positive pin of the second diode and the negative electrode of the third diode are commonly connected to the second power contact, the negative pin of the first diode and the negative pin of the second diode are commonly connected to the third power contact, the positive pin of the third diode and the positive pin of the fourth diode are commonly connected to the fourth power contact, the rectifier circuit allows a correct power connection once the first magnet segments of one of two electronic building blocks engage with the second magnet segments of the other of two electronic building blocks.

4. The electronic building block according to claim 1, wherein the first power contact, the second power contact, and the first communication contact each comprise a concave surface, and the third power contact, the fourth power contact and the second communication contact each comprise a convex surface.

5. The electronic building block according to claim 1, wherein the first power contact, the second power contact, and the first communication contact each comprise a convex surface, and the third power contact, the fourth power contact and the second communication contact each comprise a concave surface.

6. The electronic building block according to claim 1, wherein the first power contact, the second power contact, and the second communication contact each comprise a concave surface, and the third power contact, the fourth power contact and the first communication contact each comprise a convex surface.

7. The electronic building block according to claim 1, wherein the first power contact, the second power contact, and the second communication contact each comprise a convex surface, and the third power contact, the fourth power contact and the first communication contact each comprise a concave surface.

8. The electronic building block according to claim 1, wherein each of the first magnet segments and the second magnet segments has a central angle of 45 degrees.

9. A building block kit comprising a plurality of electronic building blocks, each of the electronic building blocks comprising:

a plurality of sides comprising at least one first side and at least one second side, a first magnet fixed to the at least one first side, the first magnet comprising a plurality of first magnet segments having N-poles and S-poles on upper surfaces thereof, ones of the first magnet segments having the N-poles and the other ones of the first magnet segments having the S-poles being alternately arranged;

a second magnet fixed to the at least one second side, the second magnet comprising a plurality of second magnet segments having N-poles and S-poles on upper surfaces thereof, ones of the second magnet segments having the N-poles and the other ones of the second magnet segments having the S-poles being alternately arranged, wherein the first magnet segments and the second magnet segments are arranged in such a way that the first magnet segments of one of two electronic building blocks are able to be magnetically connected to the second magnet segments of the other of two electronic building blocks when the at least one first side and the at least one second side of the two electronic building blocks abut against each other;

a first power contact, a second power contact and a first communication contact arranged on the at least one first side; and a third power contact, a fourth power contact and a second communication contact arranged on the at least one second side and respectively coming into contact with the first power contact, the second power contact, and the first communication contact when the first magnet segments of one of two electronic building blocks is connected to the second magnet segments of the other of two electronic building blocks;

wherein each of the first magnet segments and the second magnet segments is in a shape of a circular sector, the first magnet segments corporately form a first disc, and the second magnet segments corporately form a second disc, the first disc and the second disc allow the first magnet segments of one of two electronic building blocks to be connected to the second magnet segments of the other of two electronic building blocks when the at least one first side and the at least one second side of the two electronic building blocks abut against each other.

10. The building block kit according to claim 9, wherein the at least one first side and the at least one second side are rectangular, the first power contact, the second power contact and the first communication contact are arranged along a diagonal of the at least one first side, and the third power contact, the fourth power contact and the second communication contact are arranged along a diagonal of the at least one second side.

11. An electronic polyhedral building block comprising a plurality of faces, each of which comprises M sides, M being a natural number that is greater than 1, the electronic polyhedral building block comprising:

at least one first face and at least one second face, a first magnet fixed to the at least one first face, the first magnet comprising 2*M first magnet segments having N-poles and S-poles on upper surfaces thereof, ones of the first magnet segments having the N-poles and the other ones of the first magnet segments having the S-poles being alternately arranged;

a second magnet fixed to the at least one second face, the second magnet comprising 2*M second magnet segments having N-poles and S-poles on upper surfaces thereof, ones of the second magnet segments having the N-poles and the other ones of the second magnet segments having the S-poles being alternately arranged, wherein the first magnet segments and the second magnet segments are arranged in such a way that the first magnet segments of one of two electronic building blocks are able to be magnetically connected to the second magnet segments of the other of two electronic building blocks when the at least one first face and the at least one second face of the two electronic building blocks abut against each other;

a first power contact, a second power contact and a first communication contact arranged on the at least one first face; and a third power contact, a fourth power contact and a second communication contact arranged on the at least one second face and respectively coming into contact with the first power contact, the second power contact, and the first communication contact when the first magnet segments of one of two electronic building blocks is connected to the second magnet segments of the other of two electronic building blocks;

wherein the at least one first face and the at least one second face are rectangular, the first power contact, the second power contact and the first communication contact are arranged along a diagonal of the at least one first face, and the third power contact, the fourth power contact and the second communication contact are arranged along a diagonal of the at least one second face.

12. The electronic polyhedral building block according to claim 11 being a cube.

13. The electronic polyhedral building block according to claim 11, wherein the at least one first face and at least one second face are parallel to each other.

* * * * *